US008454020B1

(12) United States Patent
Orbik

(10) Patent No.: US 8,454,020 B1
(45) Date of Patent: Jun. 4, 2013

(54) GAME METHOD AND APPARATUS

(76) Inventor: Dariusz Orbik, Phoenix, AZ (US)

( * ) Notice: Subject to any disclaimer, the term of this patent is extended or adjusted under 35 U.S.C. 154(b) by 0 days.

(21) Appl. No.: 13/338,424

(22) Filed: Dec. 28, 2011

Related U.S. Application Data

(63) Continuation-in-part of application No. 12/817,622, filed on Jun. 17, 2010, now abandoned.

(60) Provisional application No. 61/267,025, filed on Dec. 5, 2009.

(51) Int. Cl.
*A63F 3/00* (2006.01)

(52) U.S. Cl.
USPC ..... 273/268; 273/146

(58) Field of Classification Search
USPC ..... 273/146, 292, 268
See application file for complete search history.

(56) References Cited

U.S. PATENT DOCUMENTS 1,481,628 A * 1/1924 Souza ..... 273/146
2,611,616 A * 9/1952 Kloss ..... 273/243
4,643,431 A 2/1987 Hilinski
4,746,126 A * 5/1988 Angileri ..... 273/249
5,676,375 A 10/1997 Pirouzkhah
5,746,432 A 5/1998 Feola
5,791,649 A 8/1998 DiSandro
6,789,796 B2 * 9/2004 Cherven ..... 273/146
7,252,289 B2 * 8/2007 Tamian ..... 273/146
2005/0218591 A1 10/2005 Torigian et al.

* cited by examiner

*Primary Examiner* — Vishu K. Mendiratta
(74) *Attorney, Agent, or Firm* — Kenneth L Tolar

(57) ABSTRACT

A game apparatus that combines the features of various games of chance, such as poker, craps and blackjack, includes a first set of six dice, each having the numbers 1-36 imprinted thereon and a second, lettered die having a select one of the letters A-F on each side thereof. A third, colored die includes a discrete one of six colors on a side thereof. The game also includes a set of playing cards, each having any one of the six colors on the colored die, any one of the letters A-F and only one of numerals 1-36 imprinted thereon. Each player is assigned a card and the numbered dice are rolled; the players alternate wagering and the lettered and colored dice are rolled and compared to each player's assigned card to determine a winner according to the greatest number of matches of colors, letters and numbers.

7 Claims, 2 Drawing Sheets

GAME METHOD AND APPARATUS

CROSS REFERENCE TO RELATED APPLICATIONS

This application is a continuation-in-part of application Ser. No. 12/817,622 filed on Jun. 17, 2010, now abandoned, and is entitled to the benefit of provisional application No. 61/267,025 filed on Dec. 5, 2009, the specifications of which are incorporated herein by reference.

BACKGROUND OF THE INVENTION

The present invention relates to a unique game that involves the use of specially-configured cards and dice.

DESCRIPTION OF THE PRIOR ART

Many people prefer to gamble on various games of chance, such as poker, blackjack and craps. However, such games eventually become mundane and are not readily playable by a multitude of players. Accordingly, there is currently a need for a more unique and entertaining game of chance.

A review of the prior art reveals various simulated games of chance. For example, U.S. Pat. No. 5,746,432 issued to Feola discloses a game wherein a wheel having a plurality of indicia thereon is spun to establish a value according to the indicia. Cards are selected and their values are added to attempt to surpass the established value without exceeding a predetermined threshold.

U.S. Pat. No. 5,791,649 issued to DiSandro discloses a poker-style board game including a board having a path thereon formed of a plurality of squares, each listing a traditional poker hand. A die determines the number of squares that each player advances a token along the path. The game further includes nine dice, each side of which has a discrete one of 52 playing-card indicia imprinted thereon; two sides have a joker or other wild-card indicia whereby each player rolls the dice to attempt to attain the poker hand appearing on the square upon which the player's token is resting.

U.S. Pat. No. 4,643,431 issued to Hilinsky discloses a blackjack board game.

U.S. Pat. No. 5,676,375 issued to Pirouzkhah discloses a card and dice game whereby each player wagers and then is dealt a number of playing cards. A dealer rolls dice to determine if a target point value is either 7 or 11. Each player attempts to achieve a hand value that closely approaches or equals the target point value.

U.S. published patent application no. 20050218591 filed on behalf of Torigian et al. discloses a board game having a path formed of a plurality of spaces that instruct participants to play any one of a variety of card or dice games, such as poker, blackjack, craps and dice poker.

Though several games resembling craps, poker and/or blackjack exist in the prior art, none of the above-described references disclose a unique game that uses various combinations of numbered, lettered and colored cards and dice according to the present invention.

SUMMARY OF THE INVENTION

The present invention relates to a game apparatus and method that combines the features of various games of chance, such as poker, craps and blackjack. The apparatus includes a first set of six dice, each having the numbers 1-36 imprinted thereon and a second, lettered die having a select one of the letters A-F on each side thereof. A third, colored die includes a discrete one of six colors on a side thereof. A fourth "tie-breaker" die includes a first integer on each of two opposing sides, a second integer of differing value on each of two opposing sides, a third integer having a different value than the first and second integers on a fifth side and wildcard indicia on a sixth side. The game also includes a set of playing cards, each having any one of the six colors on the colored die, any one of the letters A-F and only one of numerals 1-36 imprinted thereon.

The method includes assigning a card to each player and first rolling the numbered dice; each player compares the dice with his or her card to determine if the numeral thereon matches that of any of the numbered dice. The players alternate wagering until all players have either folded or "called" previous bets. The lettered die is then rolled and each player again compares the die letter with that appearing on his or her assigned card. Betting resumes and the colored die is then rolled for each player to compare with the color appearing on the assigned card. The players engage in a final round of wagering after which time each card is revealed to the other players. The player whose card has the most matches with the rolled dice wins. Ties are settled with the tie-breaker die according to a prescribed method set forth herein.

It is therefore an object of the present invention to provide a game that combines the features of poker, craps and blackjack by using uniquely-configured cards and dice.

It is another object of the present invention to provide a game that is unique and entertaining.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
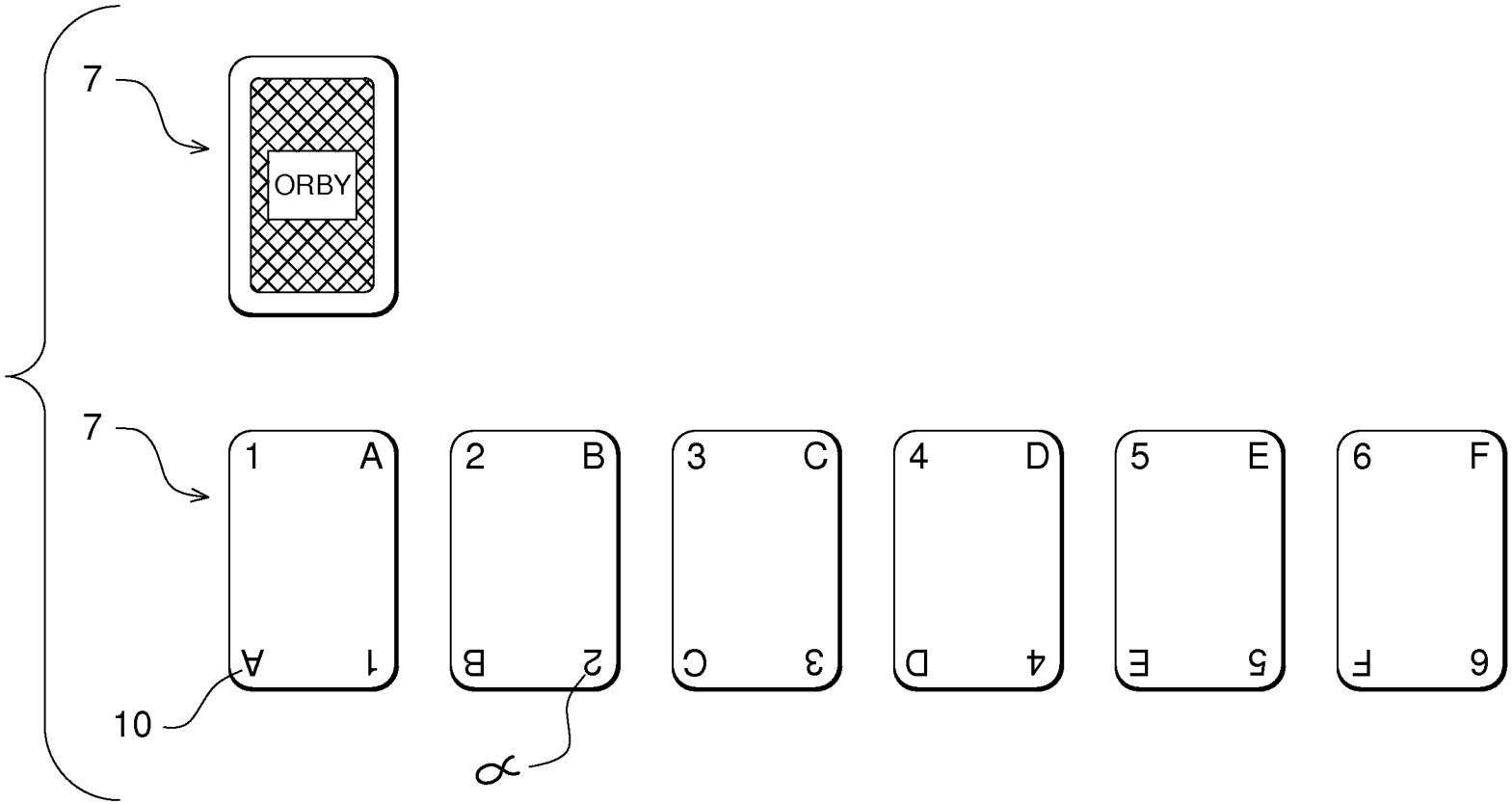
FIG. 1 depicts exemplary playing cards.
Figure 2:
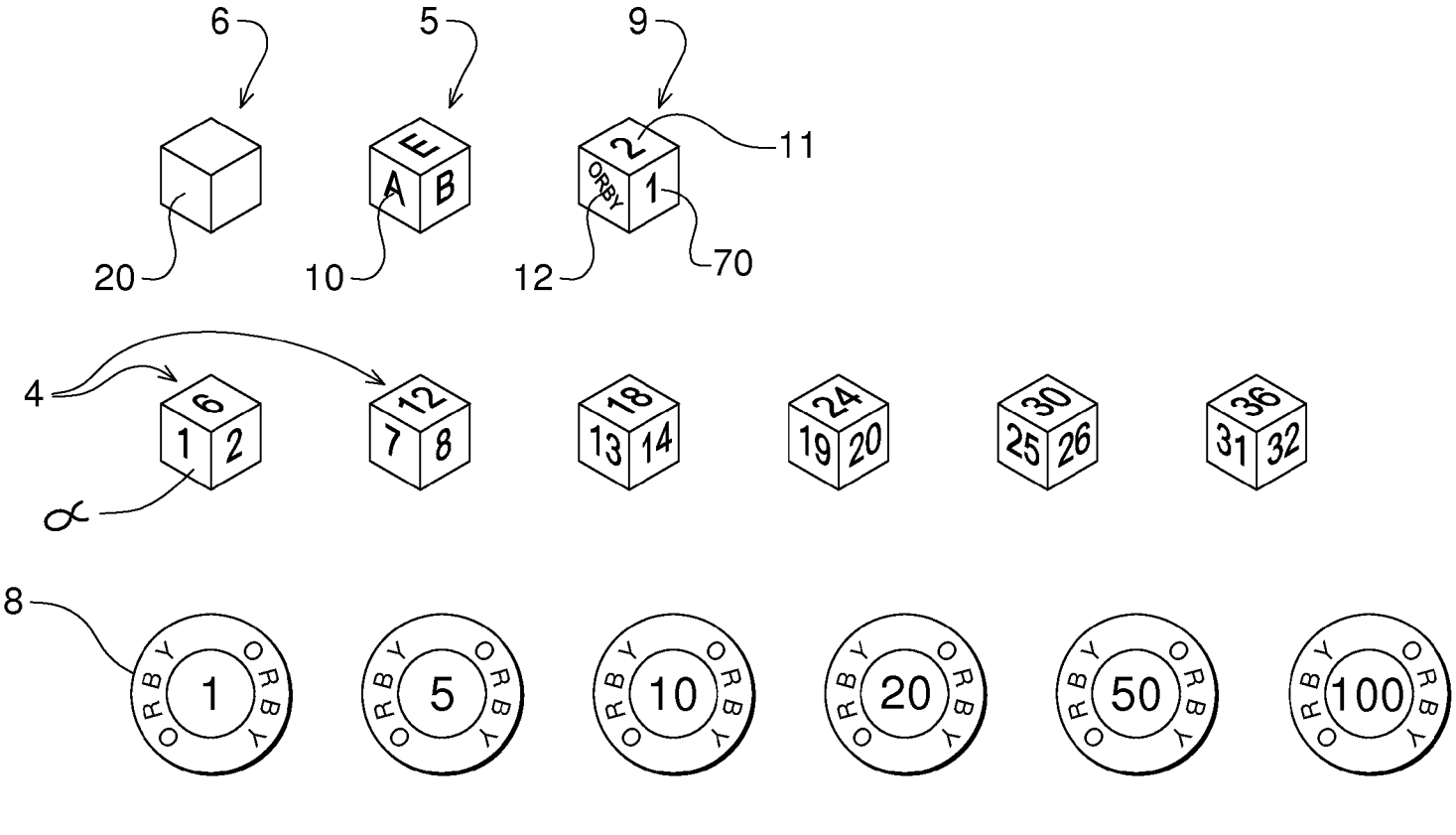
FIG. 2 depicts exemplary dice and chips.

The present invention relates to a game apparatus and method that combine the features of various games of chance, such as poker, craps and blackjack. The apparatus includes a first set of six numeric dice 4, each having the numbers 1-36 imprinted thereon. Only a discrete one of the numbers 1-36 is imprinted on a given side of a die so that none of the numerals 1-36 are duplicated or omitted. A second, lettered die 5 includes a discrete one of the letters A-F 10 on each side thereof so that none of such letters are duplicated or omitted. A third, colored die 6 includes a discrete one of six colors on a side 20 thereof so that none of the six colors are duplicated or omitted. A fourth "tie-breaker" die 9 includes a first integer 70 on each of two opposing sides, a second integer 11 of differing value on each of two opposing sides, a third integer on a fifth side having a different (and preferably lesser) value (i.e., 0) than the first and second integers and wildcard indicia 12 on a sixth side.

The game also includes a set of 36 playing cards 7, each having any one of six colors appearing on the colored die, any one of the letters A-F 10 and any one of numerals 1-36 ∝imprinted thereon. For example, the deck includes six pink cards each having a select one of the numerals 1-6 and a select one of the letters A-F imprinted thereon. Six orange cards may have a select one of the numerals 7-12 and a select one of the letters A-F thereon, etc. such that none of the numbers 1-36 are omitted or duplicated. A quantity of casino-style chips 8, each having a discrete color and denomination, are used to wager on a given game. Preferably, the color of the chips match the colors of the cards and dice.

The game method includes each player transferring one or more chips to a "dealer" as an initial ante to form a jackpot. Each player is issued a playing card, which is concealed from the other players. A dealer or designated player first tosses the numbered dice and each player compares the dice with his or her card to determine if the number appearing thereon matches that of any of the numbered dice. The players alternate wagering until all players have either folded or "called" previous bets. The dealer then tosses the colored die for each player to compare with the color of his or her assigned card and all players again alternate placing bets until all are called.

The lettered die is then rolled for each player to compare with the letter appearing on the assigned card. The players engage in a final round of wagering after which time each card is revealed to the other players. The player whose card has the most matches of colors, numbers and letters with those of the rolled dice wins.

Ties are settled with the tie-breaker die 9 as follows. All players having an identical number of matches (zero and above) each roll the tie-breaker die. Any player rolling the wildcard indicia wins the game; otherwise the player who rolls the lowest number wins unless two or more players roll an identical numeral in which case another tie-breaking roll is performed until there is an outright winner.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A game apparatus comprising:

a predetermined number of numeric dice, each of said dice having a plurality of sides, each of said sides having a discrete numeral imprinted thereon so that no single numeral is duplicated;

a lettered die having a discrete letter on each of a plurality of sides so that no single letter is duplicated;

a colored die having a discrete color on each of a plurality of sides so that no single color is duplicated;

a set of playing cards, each of said cards having a discrete color depicted thereon that is identical to at least one color on said colored die, a numeral depicted thereon that is identical to at least one numeral on any of said numeric dice and a letter depicted thereon that is identical to at least one letter on said lettered die.

2. The game according to claim 1 wherein said colored die includes six sides each having a discrete one of six colors thereon.

3. The game apparatus according to claim 2 wherein said lettered die includes six sides, each of said sides having a discrete one of six different alphabetic letters appearing thereon.

4. The game apparatus according to claim 3 further comprising a plurality of chips, each having a discrete color and denomination appearing thereon that are used to wager on a given game.

5. The game apparatus according to claim 1 wherein said predetermined number is six.

6. The game apparatus according to claim 5 wherein each of said predetermined number of sides has a discrete one of thirty-six different numerals imprinted thereon so that no single numeral is duplicated on any of said numeric dice.

7. The game apparatus according to claim 1 further comprising a tie-breaker die having a first integer on each of two opposing sides, a second integer of differing value on each of two opposing sides, a third integer on a fifth side, said third integer having a different value than the first integer and the second integer and wildcard indicia on a sixth side.

* * * * *